US010410850B2

(12) United States Patent
Gehm et al.

(10) Patent No.: US 10,410,850 B2
(45) Date of Patent: Sep. 10, 2019

(54) SYSTEMS, METHODS, AND STRUCTURES FOR COMPOUND-SPECIFIC CODING MASS SPECTROMETRY

(71) Applicant: Duke University, Durham, NC (US)

(72) Inventors: Michael E. Gehm, Durham, NC (US); Jeffrey T. Glass, Durham, NC (US); Jason J. Amsden, Durham, NC (US); Charles B. Parker, Durham, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 16/167,144

(22) Filed: Oct. 22, 2018

(65) Prior Publication Data

US 2019/0122877 A1 Apr. 25, 2019

Related U.S. Application Data

(60) Provisional application No. 62/574,851, filed on Oct. 20, 2017.

(51) Int. Cl.
*H01J 49/06* (2006.01)
*H01J 49/20* (2006.01)
*H01J 49/02* (2006.01)

(52) U.S. Cl.
CPC ..... *H01J 49/067* (2013.01); *H01J 49/025* (2013.01); *H01J 49/20* (2013.01)

(58) Field of Classification Search
USPC ..... 250/281
See application file for complete search history.

(56) References Cited

U.S. PATENT DOCUMENTS 6,580,071 B2 * 6/2003 Weinberger ..... H01J 49/0009 250/282
6,608,318 B1 * 8/2003 Perkins ..... H01J 27/02 250/281
7,521,693 B2 * 4/2009 Ward ..... B82Y 10/00 250/423 F
8,206,568 B2 * 6/2012 Branton ..... G01N 33/48721 204/409
2007/0080290 A1 * 4/2007 Parker ..... H01J 49/0027 250/288
2012/0312982 A1 12/2012 Webb
2019/0057854 A1 * 2/2019 Russell ..... H01J 9/322

FOREIGN PATENT DOCUMENTS

CN 106872559 A 6/2017
WO 2017/075470 A1 5/2017

OTHER PUBLICATIONS

Authorized Officer Blaine R. Copenheaver, International Search Report and Written Opinion issued in PCT Application No. PCT/US2018/056932 and dated Jan. 16, 2019.

* cited by examiner

*Primary Examiner* — Phillip A Johnston
(74) *Attorney, Agent, or Firm* — Kaplan Breyer Schwarz, LLP

(57) ABSTRACT

Aspects of the present disclosure describe systems, methods, and structures for compound-specific coding mass spectrometry wherein compound-specific masks/codes are positioned between an ion source and detector of a mass spectrometer.

10 Claims, 7 Drawing Sheets

*Mass Spectrum of Water*

SYSTEMS, METHODS, AND STRUCTURES FOR COMPOUND-SPECIFIC CODING MASS SPECTROMETRY

CROSS REFERENCE TO RELATED APPLICATION

This application claims the benefit of U.S. Provisional Patent Application Ser. No. 62/574,851 filed 20 Oct. 2017 which is incorporated by reference as if set forth at length herein.

STATEMENT OF GOVERNMENTAL INTEREST

This disclosure describes an invention made with United States Government support under Federal Grant No. DE-AR0000546 awarded by the ARPA-E. The United States Government has certain rights in this invention.

TECHNICAL FIELD

This disclosure relates generally to analytical science. More particularly, it pertains to systems, methods, and structures for compound-specific mass spectrometry that may advantageously find applicability in increasingly important areas including environmental monitoring and security screening—among others.

BACKGROUND

The ability to identify pollutants, contaminants, illicit drugs and/or energetic compositions is of profound societal importance in such application areas as environmental monitoring, human health, and security. An important, analytical technique for such applications is mass spectroscopy.

As is known, mass spectroscopy is an analytical technique used to identify a mass-to-charge (m/Z) ratio of ions and ion fragments when a sample is ionized, and parent ions are sufficiently energized to fragment. Identifying the mass-to-charge ratio of the of the ion fragments provides identifying information about the parent ion and sample.

Much of the utility associated with conventional mass spectroscopy results from its generality and/or versatility—the ability to identify a wide variety of ions and samples from which they are derived. As will be readily appreciated by those skilled in the art, not all applications require such generality/versatility and its resulting "cost" as measured in both instrument complexity and/or monetary expense. Accordingly, systems, methods, and structures that provide compound specific mass spectrometry—while reducing the cost and/or complexity of mass spectrometers and techniques—would represent a welcome addition to the art.

SUMMARY

An advance in the art is made according to aspects of the present disclosure directed to systems, methods, and structures for chemical-compound-specific coding mass spectrometry.

In sharp contrast to the prior art, systems, methods, and structures according to the present disclosure employ a chemical-compound specific mask interposed between an ion source and a detector structure and advantageously directs all compound-identifying ion fragments to a single detector element as opposed to the prior art which directed those ion fragments to a plurality of detector elements according to their masses.

Advantageously, chemical-compound-specific coding mass spectrometers according to the present disclosure exhibit a less complex detector structure and resulting lower cost. Of further advantage, chemical-compound-specific coding mass spectrometers according to the present disclosure are particularly well suited for specific environmental monitoring and/or security screening applications.

Viewed from an illustrative embodiment, systems, methods, and structures according to aspects of the present disclosure include a chemical-compound-specific coded mass spectrometer comprising: an ion source that produces ion fragments from the chemical compound; a mass analyzer that separates the produced ion fragments according to their mass; and a detector structure that produces signals in response to detecting the separated ion fragments CHARACTERIZED BY a compound-specific mask interposed between the ion source and the detector.

Alternative aspects of the present disclosure are FURTHER CHARACTERIZED BY the produced ion fragments are substantially all directed to a single detector element of the detector structure through the effect of the compound-specific mask. Yet additional aspects of the present disclosure are FURTHER CHARACTERIZED BY the single detector element produces a signal proportional to the number of fragments exhibiting all mass-to-charge ratios characteristic of the chemical compound.

BRIEF DESCRIPTION OF THE DRAWING

A more complete understanding of the present disclosure may be realized by reference to the accompanying drawing in which.

Figure 1:
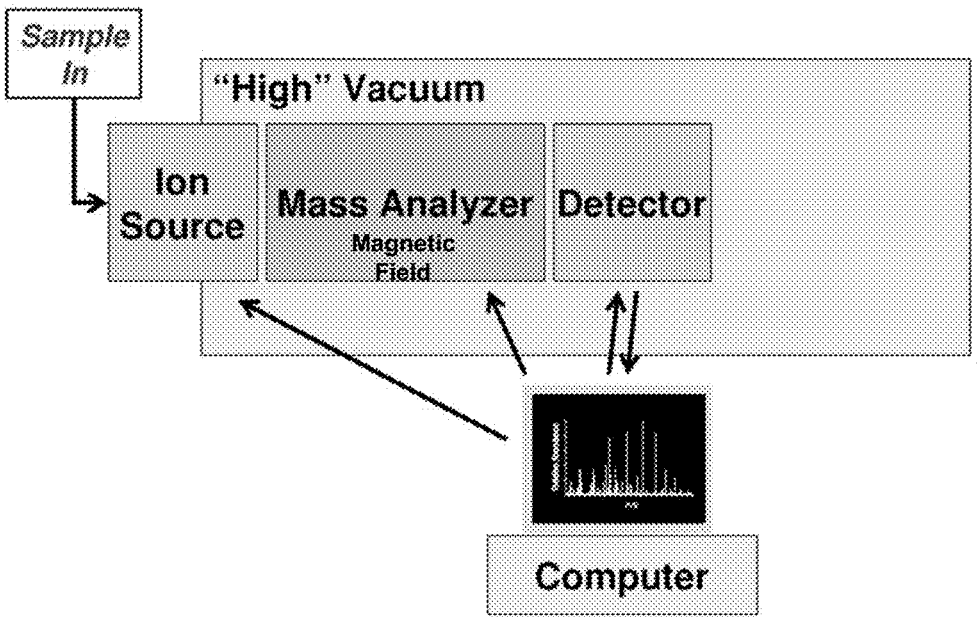
Prior Art FIG. 1
FIG. 1 is a schematic diagram illustrating a prior art, generalized mass spectrometer.

The illustrative embodiments are described more fully by the Figures and detailed description. Embodiments according to this disclosure may, however, be embodied in various forms and are not limited to specific or illustrative embodiments described in the drawing and detailed description.

DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are intended to be only for pedagogical purposes to aid the reader in understanding the principles of the disclosure and the concepts contributed by the inventor(s) to furthering the art and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that any block diagrams herein represent conceptual views of illustrative circuitry embodying the principles of the disclosure.

Unless otherwise explicitly specified herein, the FIGs comprising the drawing are not drawn to scale.

By way of some additional background, we begin by noting once again that the general mass spectrometers referred to previously and known in the art do not provide compound-specific physics and analysis. Instead, general mass spectrometers are used to chemically analyze all kinds of organic, and inorganic compounds and materials, ranging from environmental analysis to the analysis of petroleum products, trace metals, and biological materials—including products of genetic engineering.

Mass spectrometers generally operate to measure characteristics of individual molecules by converting them to ions so that they may be moved and manipulated by external electric and magnetic fields. The three essential functions of a mass spectrometer are: an ion source, a mass analyzer, and a detector.

Operationally, mass spectrometers ionize a sample—such as a gas analyte. The ionized sample may be generally filtered, and the ions are transported by electromotive forces toward a mass detector. The detector detects the ions according to their mass-to-charge ratio through a variety of methods.

Because ions are very reactive and short-lived, their formation and manipulation is necessarily conducted in a vacuum—roughly $10^{-5}$-$10^{-8}$ torr. Note that each of the mass spectrometer functional elements identified above may be performed in a variety of ways. In one common procedure, ionization is produced by a high energy beam of electrons, ion separation is achieved by accelerating and focusing the ions in a beam—which is then bent by an external magnetic field. The ions are then detected electronically, and the resulting information is then stored/analyzed by computer. Note that such generalized description is only illustrative, and that many variations of the elements/processes described above are known and/or contemplated and this disclosure should not be limited to specific illustrative examples presented.

A schematic block diagram of a mass spectrometer operating in this illustrative manner is shown in FIG. 1. The "heart" of the mass spectrometer is the ion source. Here, molecules of the sample are bombarded by electrons issuing from a heated filament. Such an arrangement is generally known as an EI—electron impact source. Note that such electron impact ionization is disclosed only as an illustrative mechanism. Those skilled in the art will readily understand that according to aspects of the present disclosure, alternative charged particle formation techniques may be employed. Such techniques include chemical ionization (CI), fast atom bombardment (FAB), field desorption (FD), electrospray ionization (ESI), and laser desorption,—among any others known in the art.

Operationally, gases and volatile liquid samples are allowed to leak into the ion source from a reservoir. Non-volatile solids and liquids may be introduced directly. Cations formed by the electron bombardment are pushed away by a charged repeller plate and accelerated toward other electrodes—having slits through which the ions pass as a beam (Not specifically shown in the block diagram). Some of these ions fragment into smaller cations and neutral fragments.

A perpendicular magnetic field deflects the ion beam in an arc whose radius is inversely proportional to the mass/charge ratio of each ion. Higher masses exhibit a lower deflection for a given charge. Conversely, lower masses exhibit a higher deflection for a given charge. By varying the strength of the magnetic field, ions exhibiting a different mass/charge ratio can be focused progressively on a detector fixed at the end of a curved tube. As we shall show and describe, a typical detector arrangement includes a plurality of detector elements, each positioned/configured to detect particular ions exhibiting particular mass-to-charge ratio(s) relative to other detected ions likewise exhibiting particular mass-to-charge ratio(s).

At this point we again note that the above disclosure is only illustrative and that a number of mass spectrometer configurations are known. Advantageously, systems, methods, and structures according to the present disclosure will operate in any of a variety of mass spectrometer configurations.

A mass spectrum is normally presented as a vertical bar graph (stick diagram), in which each bar represents an ion have a specific mass/charge ratio (m/z) and the length of the bar indicates the relative abundance of the ion. An exemplary mass spectrum 200 is illustrated graphically in FIG. 2.

As will be readily understood by those skilled in the art, the most intense ion (longest bar) is assigned an abundance of 100, and it is commonly referred to as the base peak. Most of the ions formed in a mass spectrometer have a single charge, so the m/z value is equivalent to the mass. Contemporary mass spectrometers easily distinguish (resolve) ions differing by only a single atomic mass unit (amu), and therefore provide completely accurate values for the molecular mass of a compound.

The highest-mass ion in a mass spectrum is normally considered to be the molecular ion, and lower-mass ions are fragments from the molecular ion, assuming that the sample is a single pure compound.

To fully appreciate this operation, let us use water (H2O) as an example. Referring once again to FIG. 2—which depicts an illustrative mass spectrum of water—it is known that a water molecule consists of two hydrogen (H) atoms and one oxygen (O) atom. The total mass of a water molecule is the sum of the mass of the two hydrogens (approximately 1 atomic mass unit per hydrogen) and one oxygen (approximately 16 atomic mass units per oxygen. The total mass of a water molecule is therefore 2×(1 amu)+16 amu=18 amu.

If we place water vapor into a mass spectrometer the water is fragmented into three fragments namely, [OH]+, O+, and H+. The mass spectrum of water will show peaks that can be assigned to masses of 1, 16, 17, and 18—corresponding to H+, O+, [OH]+ and base peak [H2O]+, respectively—which are shown graphically in FIG. 2.

Only certain combinations of elements can produce ions that have these masses. For example, the ammonium ion [NH4]+ also has an approximate mass of 18 atomic mass units, but there would be peaks at mass 14 and 15 in a mass spectrum of ammonia—corresponding to an N+ and [NH]+—as nitrogen has an atomic mass of 14.

Accordingly, a mass spectrometrist—or a computer with a sufficient mass spectra library—can interpret the masses and relative abundances of the ions in a mass spectrum and determine the structure and elemental composition of the molecule.

Figure 2:
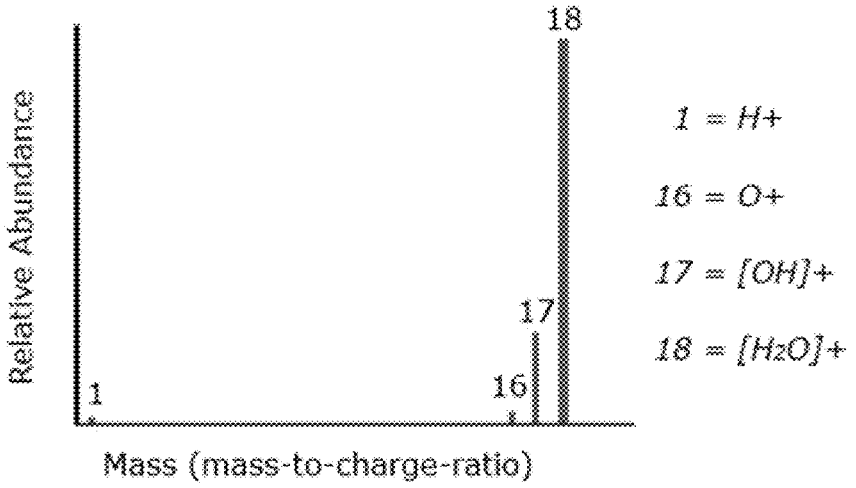
FIG. 2 is a simplified graphical illustration of a mass spectrum of water, generated by the mass spectrometer of FIG. 1.
Figure 3:
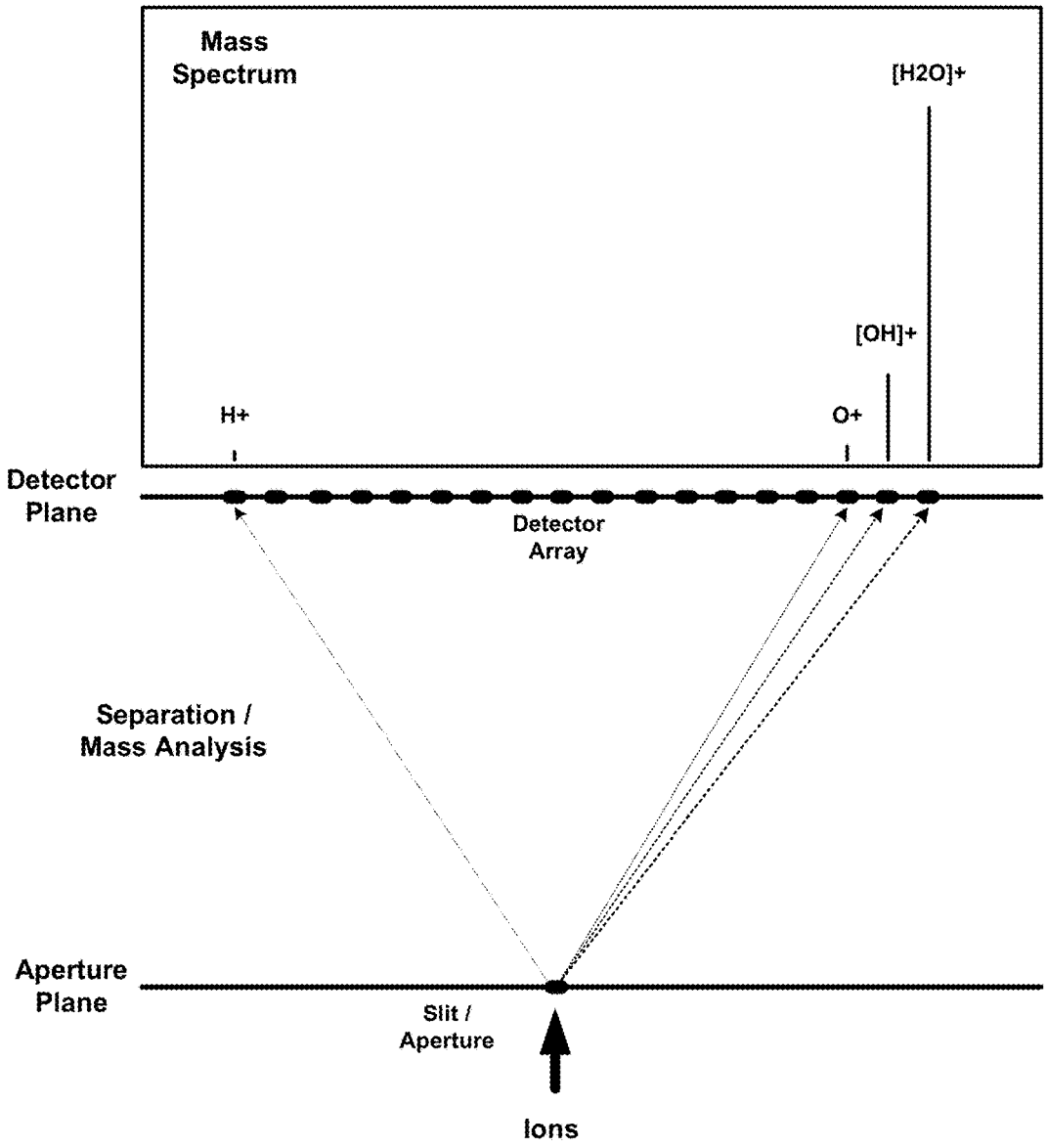
FIG. 3 is a schematic diagram illustrating a detector arrangement of multiple detector elements and its relationship to apertures and the simplified mass spectrum such as that shown in FIG. 2.

Turning now to FIG. 3, there is shown a schematic diagram depicting an illustrative aperture and detector arrangement that may produce the illustrative mass spectrum such as that shown in FIG. 2.

As may be observed from that FIG. 3, generated ions are directed/urged/accelerated through slit/aperture and subsequently undergo separation/mass analysis. Ions exhibiting different mass-to-charge ratios are deflected and subsequently detected by a detector structure positioned at a detector plane and shown including an array of individual detector elements. Ions exhibiting different mass-to-charge ratios will be deflected to different individual detector elements of the detector structure. From these detected ions, a mass spectrum may be generated and subsequently interpreted.

Those skilled in the are will readily appreciate that while such conventional mass spectrometry may permit specific compound identification, it does not do so in a compound specific manner. As we shall now show and describe however, systems, methods, and structures according to the present disclosure provide such specific compound identification in a compound specific manner.

Figure 4:
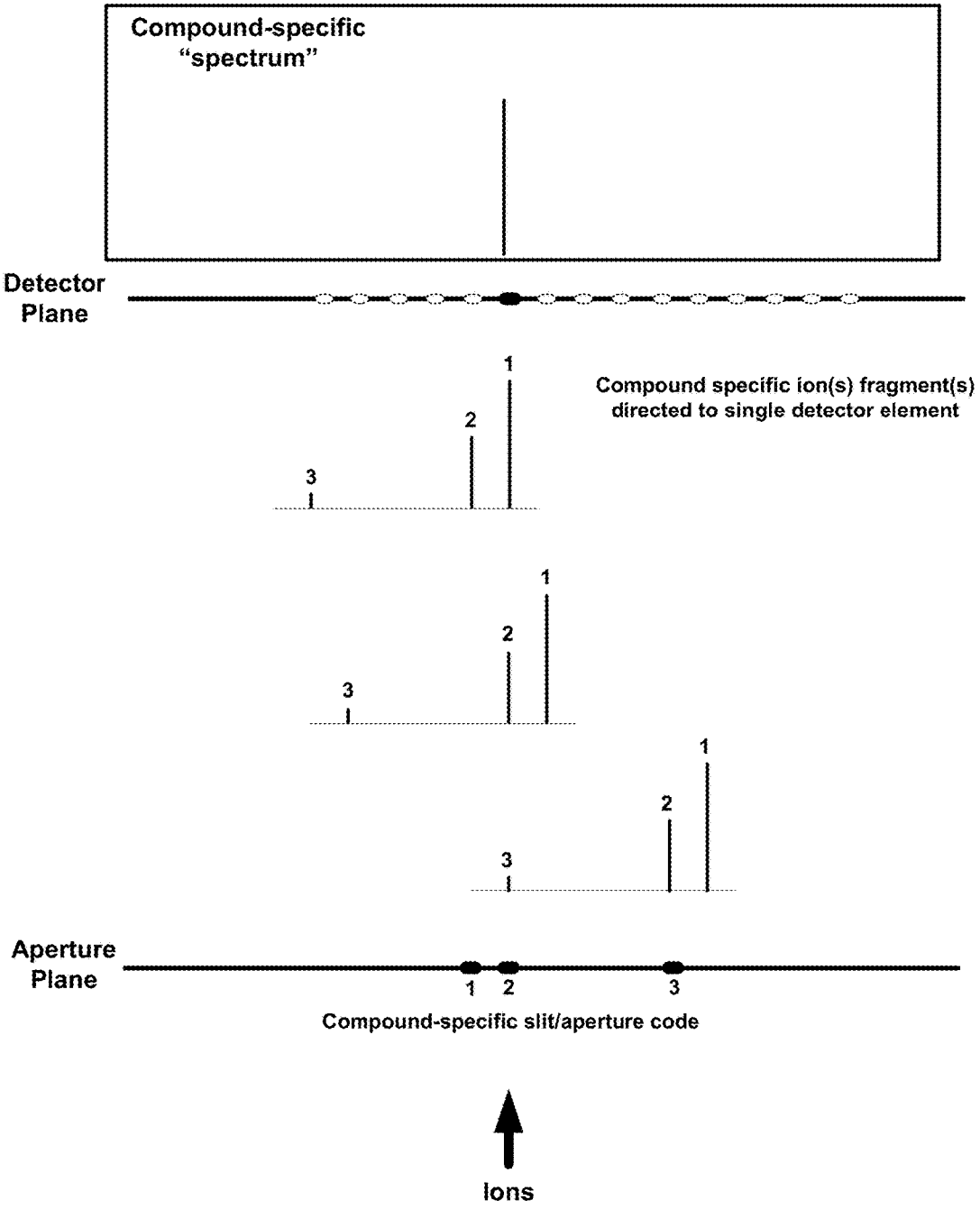
FIG. 4 is a schematic diagram of an illustrative compound-specific coding and detector arrangement according to aspects of the present disclosure.

Turning now to FIG. 4, there is shown a schematic diagram depicting an illustrative compound-specific coding aperture and detector arrangement according to aspects of the present disclosure. To simplify the discussion, the illustrative compound is one that would produce a mass spectrum including three, compound-identifying mass-to-charge ratios and therefore three peaks on a spectrum.

As shown in that FIG. 4, instead of the single slit/aperture that was employed in the arrangement illustratively shown and described previously, systems, methods, and structures according to the present disclosure employ a compound-specific slit/aperture code shown positioned in the aperture plane. Each slit/aperture (opening) in the aperture plane produces a shifted copy of the spectrum in the detector plane. As we shall show and describe further, the aperture code is configured such that any individual, compound-identifying peaks in the spectra become aligned and advantageously become detected by a single detector element.

As illustratively shown, slit 1 of the compound specific aperture code will generally shift the spectra such that the ion fragment that produces peak 1 is aligned with—and subsequently detected by—a specific detector element of a detector array positioned at the detector plane. Similarly, slit 2 of the compound specific aperture code will generally shift the spectra such that the ion fragment that produces peak 2 is aligned with—and subsequently detected by—the specific detector element of the detector element that detects peak 1. Finally, slit 3 of the compound specific aperture code will generally shift the spectra such that the ion fragment that produces peak 3 is aligned with the specific detector element that detects both peaks 1 and 2.

Accordingly, and as will be readily appreciated by those skilled in the art, all three identifying ion fragments will now produce a single compound-specific "spectrum" having—in this illustrative example—only a single peak. In this inventive manner the single detector element in the detector plane will detect signal(s) that are proportional to the number of fragments at all mass-to-charge rations of a target compound.

Those skilled in the art will now readily appreciate that mass spectroscopic systems, methods, and structures according to aspects of the present disclosure provide a compound-specificity through the use of a compound specific mask/code realized by appropriately designed/positioned slits/apertures in the mask positioned between the ion source and the detector (i.e, array).

As noted previously, compound identification in a mass spectrometer requires the ionization and subsequent detection/recognition of the ions generated and associating those ions to a specific compound. By employing a compound specific mask/code, mass spectroscopic systems, methods, and structures according to aspects of the present disclosure direct those ions associated with the specific compound and collectively necessary to identify that compound to a particular (single) detector. As such, mass spectrometers according to the present disclosure are configured to detect a specific compound, i.e., are compound-specific.

Figure 5:
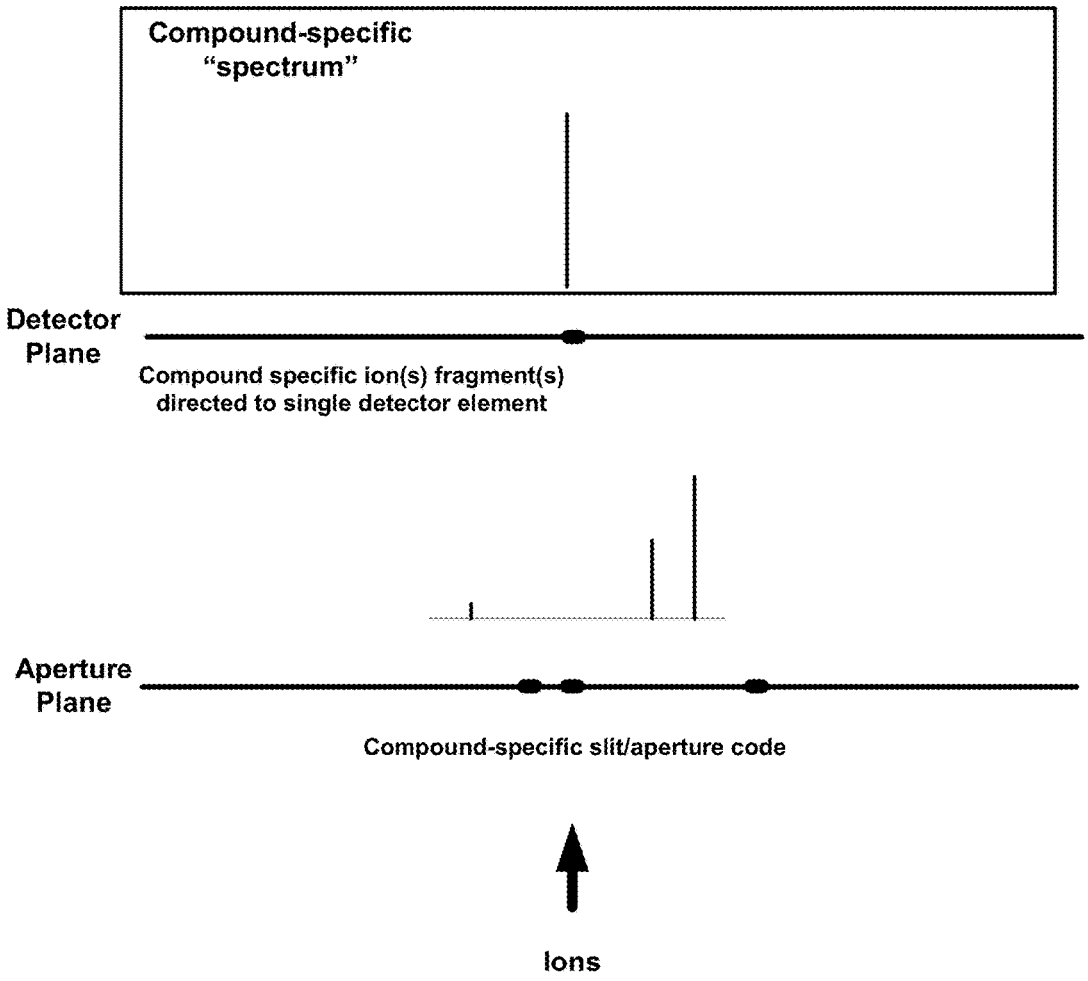
FIG. 5 is a schematic diagram of an illustrative compound-specific coding and detector arrangement that advantageously employs only a single detector element according to aspects of the present disclosure.

As those skilled in the art will now readily appreciate, systems methods, and structures according to aspects of the present disclosure may operate with significantly smaller detector array structure including those with only a single detector element such as that illustratively depicted in FIG. 5. Accordingly, systems, methods, and structures according to aspects of the present disclosure may advantageously permit alternative detectors/technologies leading to cost reductions and new applications for mass spectroscopic techniques.

With this understanding of systems, methods, and structures according to aspects of the present disclosure in place, we now extend our discussion to multiple dimensions including 2-dimensional (2D) coding (masks) that may advantageously be employed to provide additional information about compounds being analyzed/detected.

Figure 6:
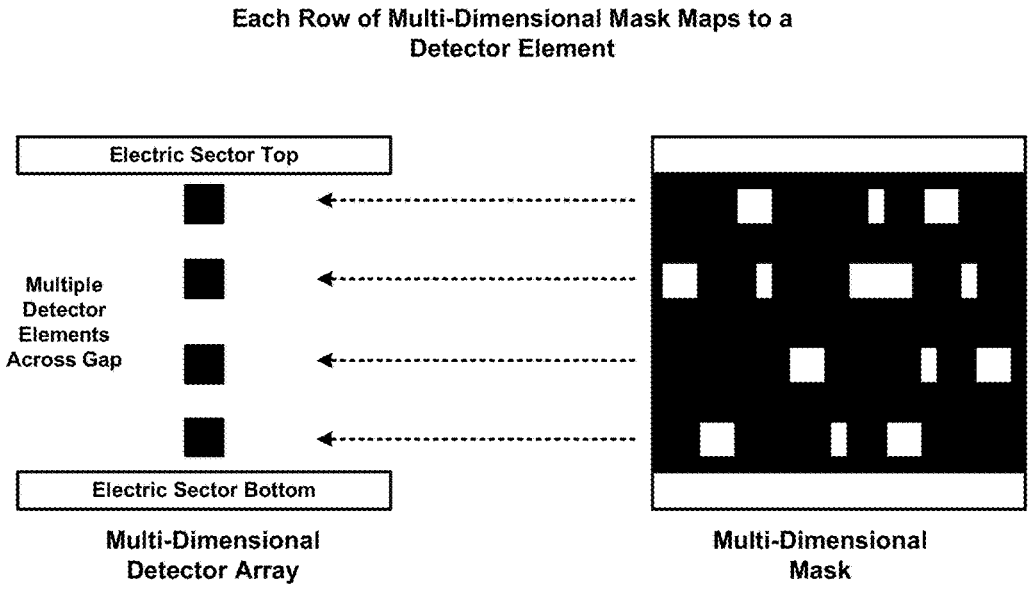
FIG. 6 is a schematic diagram of an illustrative multi-dimensional compound-specific coding and detector arrangement that advantageously employs only a single detector element in a particular dimension according to aspects of the present disclosure.

Turning now to FIG. 6, there is shown a simplified schematic diagram illustrating such a 2D mask. As depicted in that figure, a multi-dimensional mask includes a number of rows of individual, compound-specific masks (codes)—each of which is associated with a particular detector element in a multi-dimensional detector array. Since each detector element will detect the compound its associated mask is configured for, multiple compounds may be detected at a time providing either a multi-compound detection/analysis or—alternatively—a mechanism to refine determinations and eliminate confusingly similar compounds.

Figure 7:
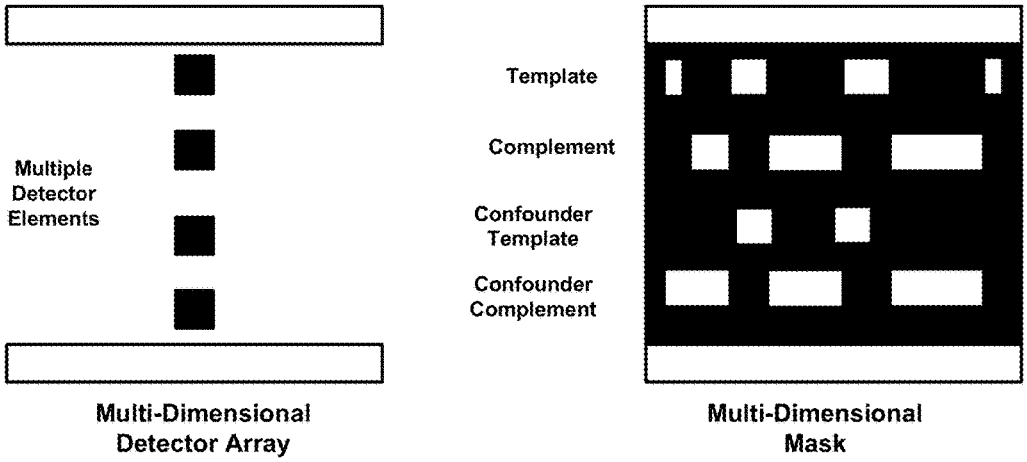
FIG. 7 is a schematic diagram of an illustrative multi-dimensional compound-specific coding/mask/template that advantageously improves specificity of detection and/or mitigates confusingly similar compounds—according to aspects of the present disclosure.

With reference now to FIG. 7, there is shown a schematic diagram of an illustrative 2D mask/template that may more specifically detect/identify a particular compound and/or be less susceptible to ambiguities resulting from confusingly similar compounds—i.e., compounds exhibiting similar fragmentation ions and abundance(s).

By way of illustrative example, consider two mask/template patterns. One is the matched template to the compound of interest which, for the sake of this discussion, we call the "in-band" (IB) mask and the other is the complement of this template, which we call the "out-of-band" (OOB) mask. As may be observed, a compound-specific mask and its complement will generally exhibit complementary aperture positions—that is to say a compound specific mask will include a pre-defined, compound-specific set of aperture(s)/slits, while its complement will exhibit a complementary set of apertures namely, apertures located in position(s) where the compound specific mask has none.

By including both the compound-specific template to the mask and its complement template, compound discrimination may be made in conjunction with a multiple detector element structure such as that illustratively shown in FIG. 7 by observing the IB+OOB and OOB/IB peaks produced.

Note that even when employing a compound specific template and its complement that particular compound determinations may be difficult when those compounds exhibit a subset of mass peaks for a target compound of interest. Advantageously, and according to aspects of the present disclosure and illustrated in FIG. 7, such determination may be possible when the multi-dimensional mask includes a template—and complement—of those confounding (confusing) compounds.

We note that the performance of a compound-specific mass spectrometer is challenged when applied to a trace-detection application. As will be readily understood and appreciated, such application oftentimes involves a very low level (ppm/ppb) detection in a large background. If the background includes fragments exhibiting mass-to-charge ratio(s) that overlap those of a target compound, the peaks of the target compound may be overwhelmed by the background. Conversely, if there is no overlap, then operation proceeds unencumbered similar to a pure compound sample.

As noted above however, systems, methods, and structures according to aspects of the present disclosure may advantageously include template and complement of the background—in this illustrative example—and an effective discrimination may be made. Alternatively, known techniques may be employed prior to sample ionization such as gas chromatography or other techniques to separate the compound of interest from a background before ionization and detection.

Those skilled in the art will now readily understand and appreciate that systems, method, and structures for compound-specific mass spectrometry provide a number of advantages as compared to the prior. Of particular advantage, such compound specific coding mass spectrometry is the cost/size/weight/power reduction of using a relatively small—i.e., several detector element/pixel—detector structure as compared with a complex detector array of the prior art. Such advantages are particularly useful in applications where inexpensive/small/low-power sensors are required for sensitive detection of a small number of compounds, and in particular relatively simple compounds. As noted, such applications include environmental monitoring of pollutants, industrial contaminants and household chemicals as well as security screening for explosives and drugs.

At this point, while we have presented this disclosure using some specific examples, those skilled in the art will recognize that our teachings are not so limited. Accordingly, this disclosure should be only limited by the scope of the claims attached hereto.

The invention claimed is:

1. A chemical-compound-specific coded mass spectrometer comprising:

an ion source that produces ion fragments from the chemical compound;

a mass analyzer that separates the produced ion fragments according to their mass; and a detector structure that produces signals in response to detecting the separated ion fragments;

CHARACTERIZED BY:

a compound-specific mask interposed between the ion source and the detector.

2. The chemical-compound-specific mass spectrometer of claim 1 FURTHER CHARACTERIZED BY:

the produced ion fragments are substantially all directed to a single detector element of the detector structure through the effect of the compound-specific mask.

3. The chemical-compound-specific mass spectrometer of claim 2 FURTHER CHARACTERIZED BY:

the single detector element produces a signal proportional to the number of fragments exhibiting all mass-to-charge ratios characteristic of the chemical compound.

4. The chemical-compound-specific mass spectrometer of claim 3 FURTHER CHARACTERIZED BY:

the compound-specific mask includes a plurality of slit/apertures, each individual slit/aperture configured to direct a particular generated ion fragment to the single detector.

5. The chemical-compound-specific mass spectrometer of claim 3 wherein the detector element is positioned at a detector plane and the compound-specific mask is positioned at an aperture plane, said mass spectrometer FURTHER CHARACTERIZED BY:

the compound-specific mask includes a plurality of slit/apertures, each individual slit/aperture configured to generate a shifted copy of the compounds spectrum onto the detector plane, wherein the shifting results in a particular, generated ion fragment for each shifted copy being directed to the single detector.

6. The chemical-compound-specific mass spectrometer of claim 1 FURTHER CHARACTERIZED BY:

the compound-specific mask is a two-dimensional coded mask having n rows of apertures; and the detector structure is a 1×n array of individual detectors, each of the individual detectors corresponding to a respective one of the mask rows.

7. The chemical-compound-specific mass spectrometer of claim 6 FURTHER CHARACTERIZED BY:

the two-dimensional compound specific mask includes plurality of slit/apertures arranged in a first row, each individual slit/aperture in the first row configured to direct a particular generated ion fragment to the individual detector corresponding to that first row; and the two-dimensional compound specific mask includes a plurality of slit/apertures arranged in a second row, wherein the arrangement of slit/apertures in the second row is the complement to the arrangement of slit/apertures in the first row.

8. The chemical-compound-specific mass spectrometer of claim 7 FURTHER CHARACTERIZED BY:

the two-dimensional compound specific mask includes plurality of slit/apertures arranged in a third row, each individual slit/aperture in the third row configured to direct a particular generated ion fragment to the individual detector corresponding to that third row wherein the particular generated ion fragment directed by the third row slit/aperture is an ion fragment generated from a cofounder of the chemical compound; and the two-dimensional compound specific mask includes a plurality of slit/apertures arranged in a fourth row, wherein the arrangement of slit/apertures in the fourth row is the complement to the arrangement of slit/apertures in the third row.

9. The chemical-compound-specific mass spectrometer of claim 8 FURTHER CHARACTERIZED BY:

the individual detector element corresponding to the first row produces a first signal (IB) and the individual detector element corresponding to the second row produces a second signal (OOB) and the chemical compound is discriminated by comparing IB+OOB and OOB/IB.

10. A chemical-compound-specific mass spectroscopic method comprising:

generating compound-identifying ion fragments from the chemical compound;

separating the compound-identifying ion fragments according to their mass; and directing the compound-identifying ion fragments to a single detector element of a multi-element detector through the effect of a compound-specific mask positioned between an ion source that generates the compound-identifying ion fragments and the detector.

* * * * *